US005743476A

United States Patent [19]

Morikawa et al.

[11] Patent Number: 5,743,476

[45] Date of Patent: Apr. 28, 1998

[54] CONCRETE CRUSHER

[75] Inventors: Sumio Morikawa; Toshiji Ohga; Nobuyuki Zakohji, all of Osaka, Japan

[73] Assignee: Ohyodo Komatsu Co., Ltd., Osaka, Japan

[21] Appl. No.: 785,950

[22] Filed: Jan. 22, 1997

[30] Foreign Application Priority Data

Nov. 7, 1996 [JP] Japan ..... 8-295275

[51] Int. Cl.[6] ..... B02C 1/02

[52] U.S. Cl. ..... 241/101.73; 241/262; 241/291

[58] Field of Search ..... 241/101.73, 262, 241/264, 291; 30/134

[56] References Cited

U.S. PATENT DOCUMENTS 3,058,213 10/1962 Sandsto ..... 30/134
4,198,747 4/1980 Labounty ..... 30/134
4,550,634 11/1985 Speegle ..... 30/134 X
4,776,524 10/1988 Sakato ..... 241/101.73
5,060,378 10/1991 Labounty et al. ..... 30/134
5,292,079 3/1994 Zakohji ..... 241/264
5,301,882 4/1994 Morikawa et al. ..... 241/101.73
5,619,881 4/1997 Morikawa et al. ..... 30/134 X

*Primary Examiner*—John M. Husar
*Attorney, Agent, or Firm*—Morrison Law Firm

[57] ABSTRACT

A concrete crusher has a crushing surface 1*a* on a stationary lower jaw 1 and it is formed so that its axial cross-section is V-shaped. A main crushing blade 5 is installed on a crushing surface 2*a* of a movable upper jaw 2 pivoted to the lower jaw and is opposite the lowermost portion of stationary crushing surface 1*a*. Supporting crushing blades 6 are installed on the upper jaw at opposite sides of the main crushing blade 5 and have shorter blade heights than main crushing blade 5.

2 Claims, 5 Drawing Sheets

CONCRETE CRUSHER

BACKGROUND OF THE INVENTION

The present invention relates to a crusher used in the demolition of concrete structures such as buildings, wall barriers and the like for crushing concrete building blocks, beams, rubble pieces, etc.

FIG. 6 depicts a known type of concrete crusher used in building demolition areas for crushing concrete blocks. This concrete crusher has a movable upper jaw 12 which is driven by a hydraulic cylinder, and a stationary lower jaw 11 which can be attached to the end of a boom or the like on a power shovel. Movable upper jaw 12 is pivot mounted to stationary jaw 11 by way of an axle O' so that it can open and close. Concrete blocks and the like are placed between the respective crushing surfaces 11*a*, 12*a* (the surface facing the other jaw) of both jaws 11, 12 and are then crushed and pulverized by the closing motion of movable upper jaw 12.

In another type of crusher of the prior art as shown in FIG. 7, a crushing blade 15 which bites into and crushes the concrete block is attached to a crushing surface 12 a (surface facing the lower jaw) of movable upper jaw 12. Crushing surface 11*a* of lower jaw 11 is a plane or a planar lattice.

In order to crush evenly and finely and for a blade of the upper jaw to hit the concrete block accurately in most advantageous striking location, the preferred position of a scooped up concrete block or piece to be crushed is to be symmetrical of a center axial position of crushing surface 11*a* of stationary lower jaw 11. In reality, it is often the case that the concrete blocks shift from the center off to one side when they are scooped up. It is then necessary to adjust the insertion position back towards the center of the stationary lower jaw crushing surface by operating the boom, arm, rotating device, or the like. As a result, operating time is lost, extra work is involved, and processing speed becomes markedly lower.

In order to respond to shifts in position of the object to be crushed, the prior art employed multiple crushing blades positioned axially in multiple locations on the movable upper jaw. If a block is large, the large number of blades results in multiple blades hitting the block simultaneously. The biting strength of each individual blade is weakened, and crushing becomes more difficult.

OBJECT AND SUMMARY OF THE INVENTION

The object of the present invention is to increase the processing speed of a concrete crusher operation by making adjustment of insertion position of the concrete block on a crushing surface unnecessary.

A further object of the present invention is to maximize the crushing strength possible with the crusher by assuring placement of a concrete block in the crusher at position where maximum crushing strength is realized.

In order to achieve the above objects, the present invention can crush a concrete block or like piece by the closing of a movable upper jaw against the concrete block while it is resting on a stationary lower jaw, the stationary jaw being attached by an axle or pivot to the movable upper jaw. The cross-section of a crushing surface of the stationary lower jaw taken along a jaw pivot axis direction is of V-shaped, arcuate or like configuration wherein such surface inclines or depresses toward a low point at a central axial position of the crushing surface. Such surface configuration facilitates receptive holding of a concrete block on said surface in position wherein it is symmetrical of the center axial position of the surface. A crushing surface of the movable upper jaw has a main crushing blade which moves in a crushing course coinciding with the lowest point of the stationary crushing surface. Supporting crushing blades which have lower blade heights than the main crushing blade are positioned around the main crushing blade. The main crushing blade can be a single blade stretched lengthwise along the movable upper jaw, or it can be multiple blades in a single row.

A waste passage can run through the stationary lower jaw. The waste opening opens in the lowest point of the stationary crushing surface of the stationary lower jaw and allows penetration therethrough of the main crushing blade.

Shredding blades can be attached to both the stationary lower jaw and the movable upper jaw, where they have a shredding action by their mutual engagement for the purpose of shearing reinforcing rods and like components commonly embedded is the demolished concrete structure.

The above and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
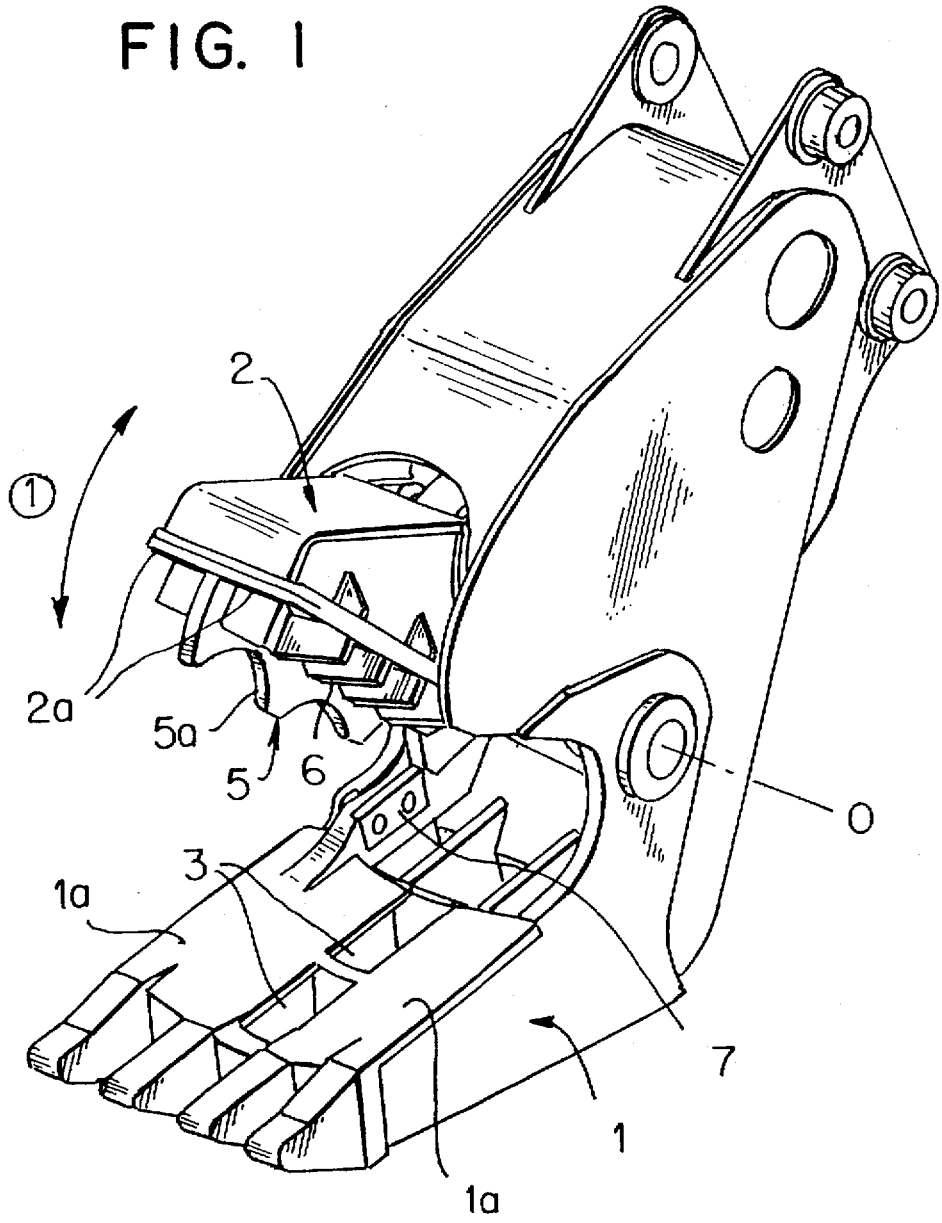
FIG. 1 is a perspective view of a concrete crusher made in accordance with the invention.
Figure 2:
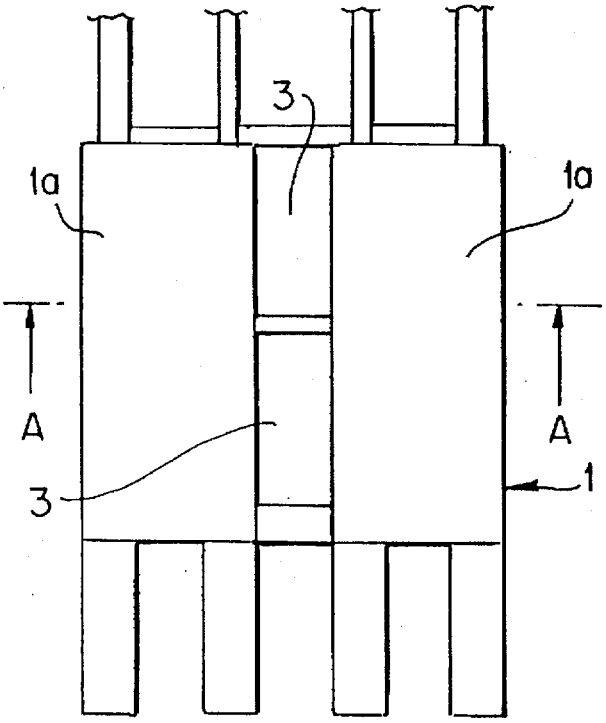
FIG. 2 is a plan view showing of a stationary lower jaw of the concrete crusher.
Figure 3:
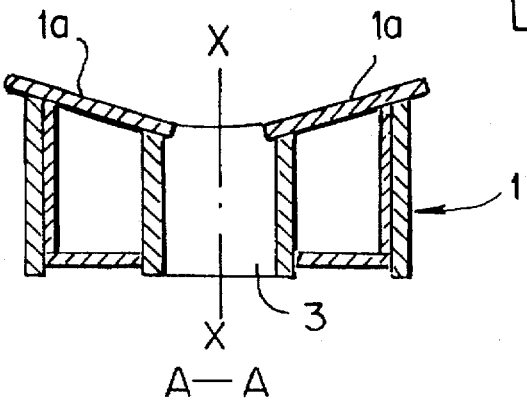
FIG. 3 is a vertical cross-sectional view taken on the line A—A in FIG. 2.

Referring to FIGS. 1–3, the concrete crusher 10 of the present invention has a stationary or fixed lower jaw 1 which is pivoted as by an axle O to a movable upper jaw 2 which can be opened and closed. Movable upper jaw 2 is driven by a hydraulic cylinder (not shown) and opens and closes in the direction of arrow 1 and with respect to stationary lower jaw 1, the stationary jaw, e.g., being attached to a boom or the like of a power shovel, such being a common practice in the art.

Stationary lower jaw 1 has a crushing surface 1*a* of depressed shape. The depressed shape can be defined by lower jaw cross-section taken in a direction along a jaw pivot axis, the cross-section being, e.g., V-shaped. V-shaped is understood herein to mean a shape wherein the distance between the two crushing surface parts 1*a* located on either side of center line X—X increases gradually as the said surfaces go upward, i.e., approach opposing movable upper jaw 2. The incline angle of crushing surface 1*a* is arbitrary. The left and right crushing surfaces 1*a*, 1*a* can have different incline angles. Further, either one or both of crushing surfaces 1*a*, 1*a* could be a composite inclined surface with two inclined surfaces with differing incline angles. The crushing surface 1*a* are shown as being planar, but such surfaces could be curved, e.g., of concave shape or even slight convex shape.

The lowest portion (axial center position) of lower jaw crushing surface 1*a* has an opening which communicates with a waste passage 3 passing through stationary lower jaw 1, the waste passage being provided to facilitate carry away of crushed concrete particles from crushing surface 1*a*. The waste passage 3 can be compartmentalized into plural sections (2 in the FIG. 1 depiction), the waste passage being disposed in crushing surface 1*a* orthogonal to the pivot axis. Waste passage 3 does not have to be in a plurality of passage sections, but can also be as a single passage.

Crushing surface 2*a* of movable upper jaw 2 is constructed so that it is approximately equal in length as crushing surface 1*a* of stationary lower jaw 1, length in this respect being the dimension orthogonal to the pivot axis. Upper jaw carries a main crushing blade 5 installed lengthwise along movable upper jaw 2 at the axial center of the latter. In other words, crushing blade 5 is opposite the lowermost portion of stationary crushing surface 1*a* and its movement course during crushing is in a plane coincident with center line X—X. Main crushing blade 5 has a wave form tip surface 5*a*.

When movable upper jaw 2 closes, the whole blade can enter waste opening 3. As seen in FIG. 1, main crushing blade 5 is continuous in length from rear to front of the upper jaw, but it also could be made as a number of individual aligned crushing blades forming a single row in the axial center of crushing surface 2*a*.

Around main crushing blade 5 (for example on either side) on upper jaw 2 and orthogonal to the direction of main crushing blade 5 so same are generally parallel to the pivot axis, are a plurality of auxiliary crushing blades 6, these being arrayed front to rear spaced one from another at each side of main crushing blade 5. The frontmost of these auxiliary crushing blades 6 in each row of such is rectangular, but the others following in a row can be trapezoidal as clearly seen in FIG. 1.

Blade heights get shorter going axially towards either side of movable upper jaw 2. Auxiliary crushing blades 6 all have blade heights shorter than main crushing blade 5 and thus during operation reach their crushing position later than main crushing blade 5.

Stationary lower jaw 1 carries at an inner part thereof, a shredding blade 7. This shredding blade 7 can be used to cooperate with a like blade (not shown) carried on upper movable jaw 2 to cut or shear any reinforcing steel or steel frame component mixed in with the concrete block.

Figure 4A:
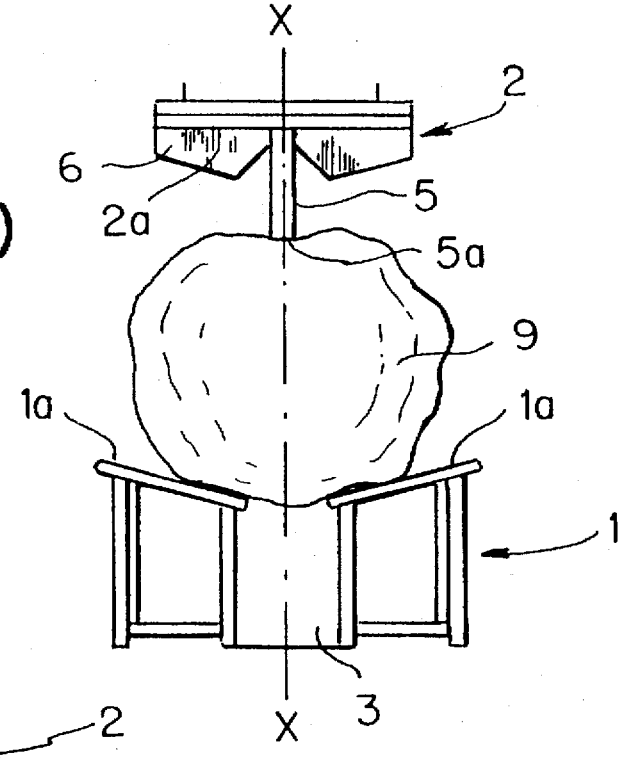
FIGS. 4(*a*), 4(*b*) and 4(*c*) are schematic cross-sectional showings of successive stages of crushing of a concrete block from an initial crush stage to a near final crush stage, showing additionally the manner in which reduced size crushed concrete and other debris pass through a waste opening in the lower jaw.
Figure 4B:
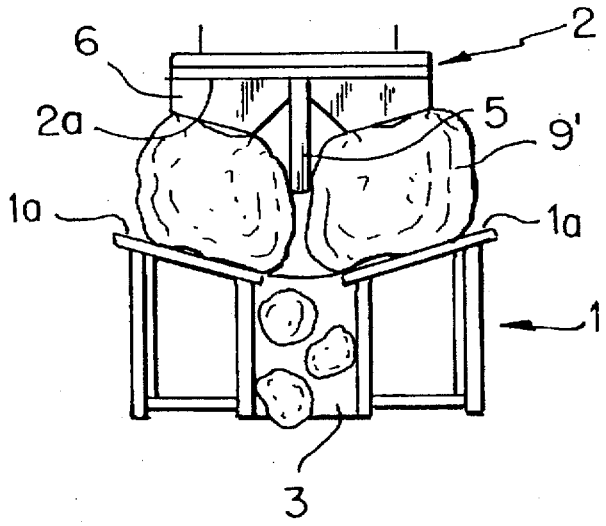
Figure 4C:
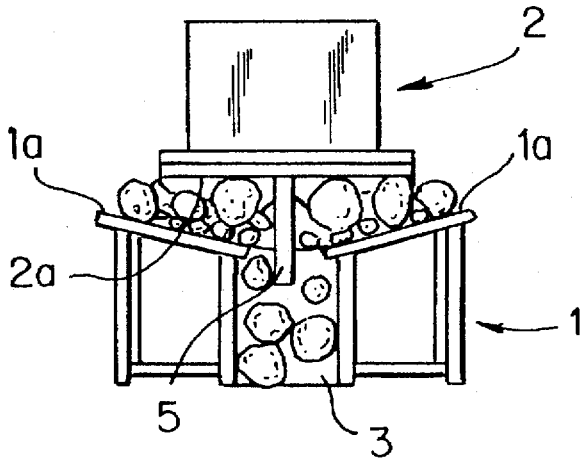
Figure 6:
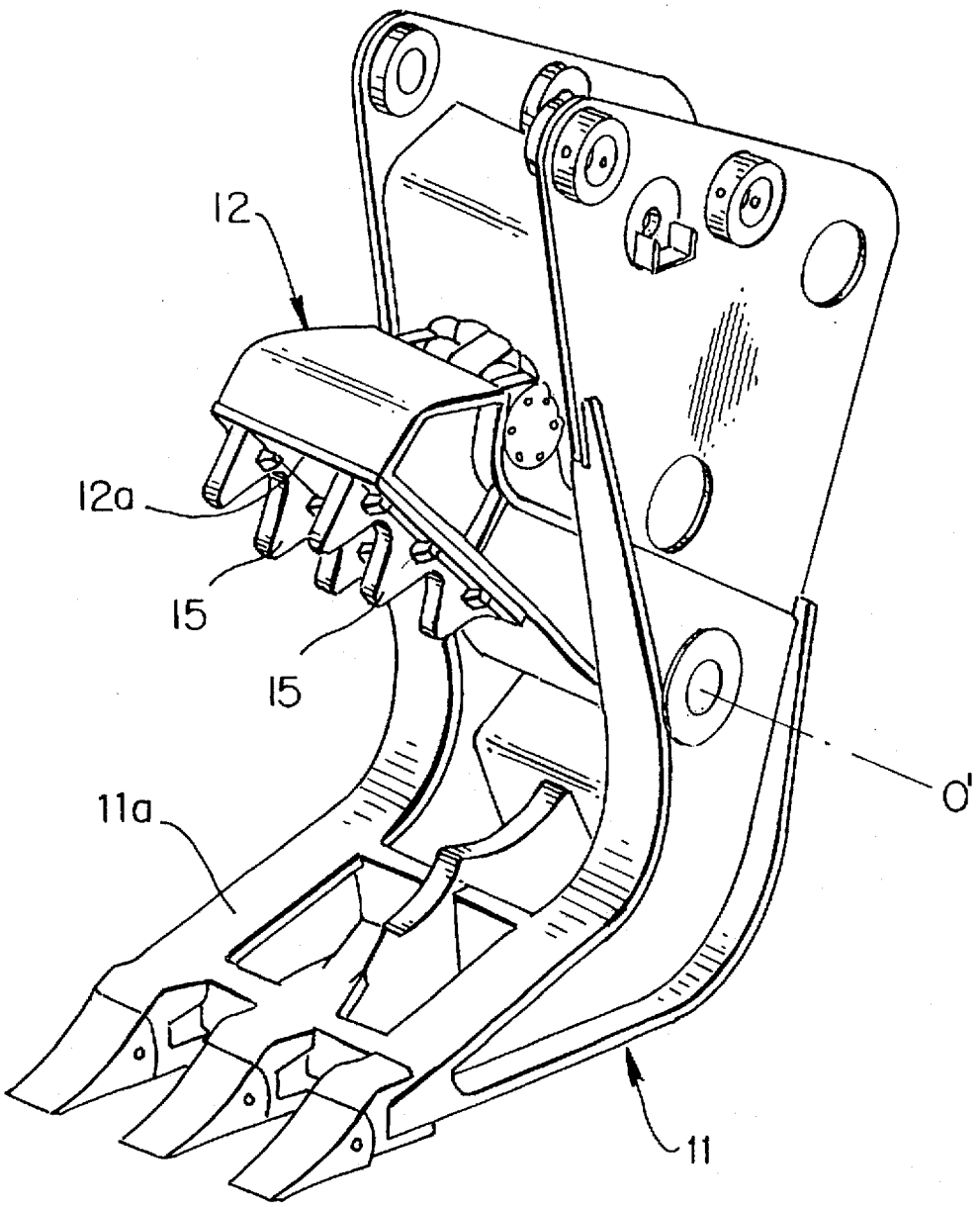
FIG. 6 PRIOR ART
FIG. 6 is a perspective view of a crusher of the prior art.
Figure 7:
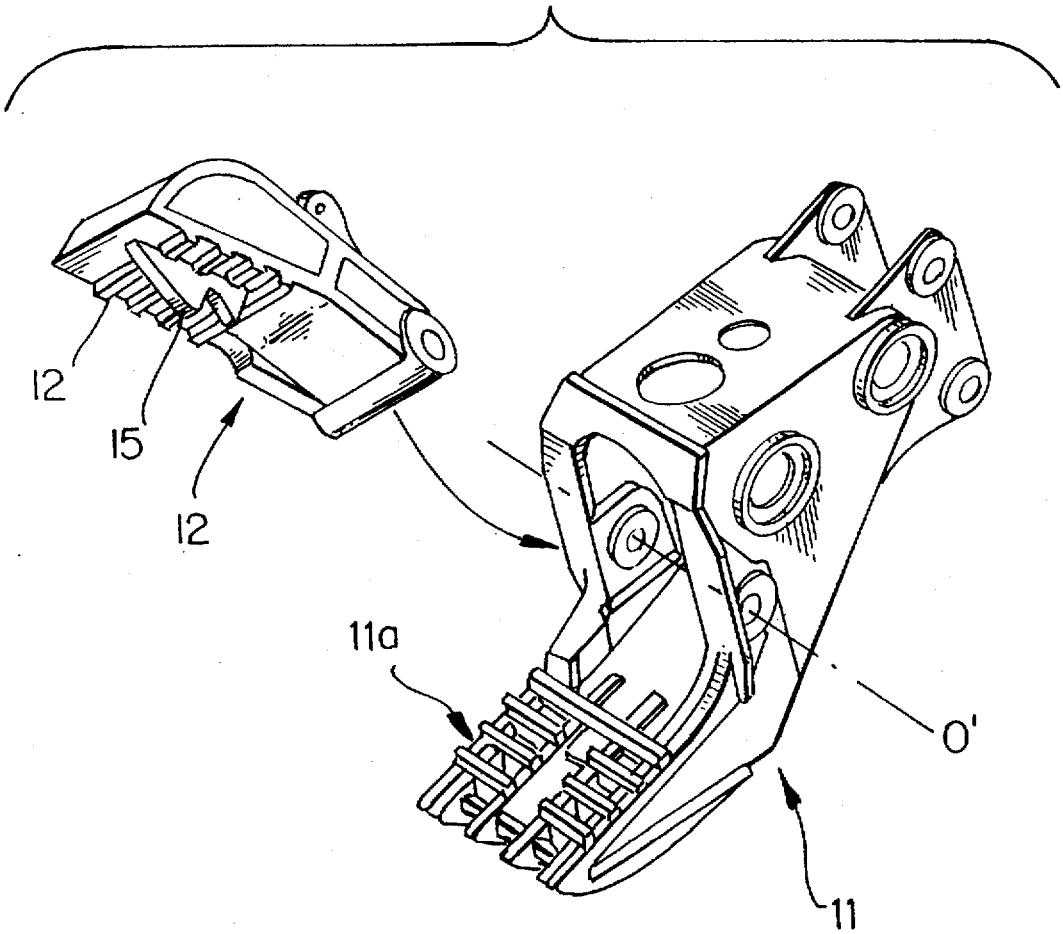
FIG. 7 PRIOR ART
FIG. 7 is a perspective view of another prior art crusher.

In using the concrete crusher, a hydraulic shovel on which the crusher is carried is operated and concrete blocks or pieces at a demolition site are scooped up with stationary lower jaw 1, upper jaw 2 being in open position. Referring to FIG. 4(*a*), concrete block 9 is brought to crushing surface 1*a* of stationary lower jaw 1. Concrete block 9 naturally will tend to settle at the lowest part of crushing surface 1*a* and be symmetrical of center line X—X. In other words, block 9 will occupy a position centralized on crushing surface 1*a*.

Referring to FIG. 4(*b*), when movable upper jaw 2 is closed, main crushing blade 5 attached to movable upper jaw 2 bites into concrete block 9 and crushes it breaking it into two or more pieces. Because crushing blade 5 is attached along central line X—X, crushing of concrete block 9 into at least two parts will be along approximately the center of block 9. During and after this crushing, concrete particles of certain size and smaller can discard from stationary lower jaw 1 by gravity passing through waste passage 3.

By further closing movable upper jaw 2, supporting crushing blades 6, which reach crushing position later than main crushing blade 5, will crush broken-up concrete blocks 9' to smaller sized concrete pieces.

With further closing of movable jaw 2 and as seen from FIG. 4(*c*), main crushing blade 5 will enter waste passage 3. Because the space between both sides of crushing surfaces 2*a* and 1*a* narrows in the downward direction, any remaining broken-up concrete blocks are crushed finer, not only by supporting blades 6, but also by this closing of crushing surfaces 1*a*, 2*a* with the effect that much of the concrete is rendered to pulverized condition.

After being pulverized, concrete particles will slide off the surface of stationary crushing surface 1*a* naturally or by shaking the crusher using the boom. The particles are disposed smoothly from waste passage 3.

Because scooped up concrete blocks tend to naturally collect in the center of stationary crushing surface 1*a*, there is no need to adjust the concrete block position as in prior art. As a result, time lost and work involved in adjusting block position is reduced, and processing speed can be increased.

Because the concrete block is initially crushed by a single (or a single row) main crushing blade 5 in the axial center of movable upper jaw 2, crushing strength can be concentrated on the concrete block for this initial crush which requires the greatest strength. A smooth crushing is made possible with a small amount of power.

After breaking with the initial crushing, the broken-up concrete blocks 9' are further crushed by the plural supporting crushing blades 6 which reach crushing position after the main crushing blade. Because the concrete block is already broken up, it is possible to crush with a small amount of power, even with a plurality of supporting crushing blades.

Because there is a waste passage 3 in stationary lower jaw 1, crushed particles can be successively removed outside the crushing surface. There is no need to stop operation due to blockage by crushed parts. Waste passage 3 will receive main crushing blade 5 in the last step, and crushing supporting crushing blades 6 and crushing surfaces 1*a* and 2*a* can continue to operate to produce as fine a crush as possible.

Figure 5:
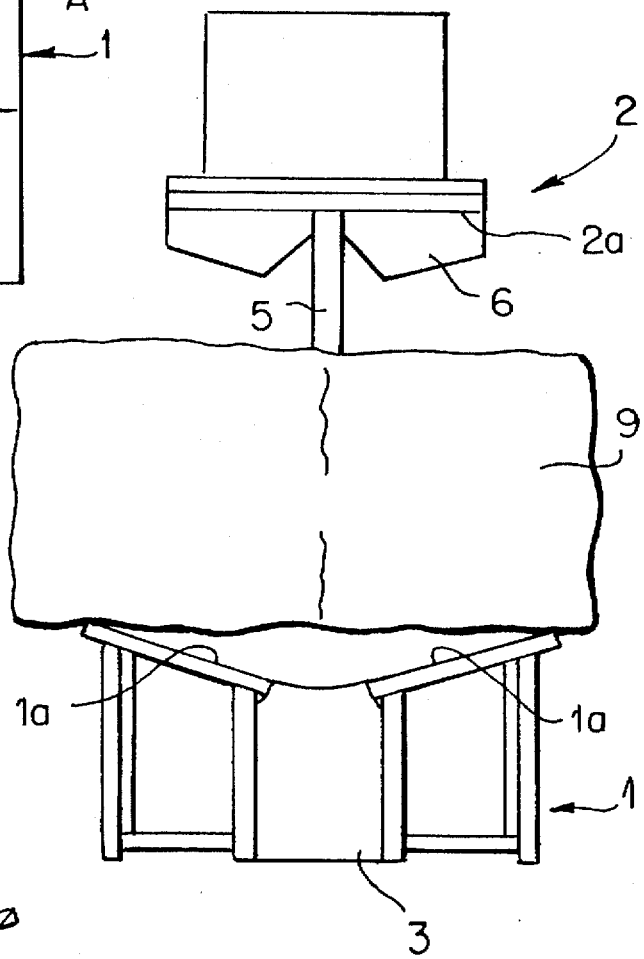
FIG. 5 is a cross-sectional diagram on enlarged scale depicting initiation of crushing of a very large concrete block.

Referring to FIG. 5, a wide concrete block is supported at two points by stationary crushing surface 1*a* (the two ends of the V-shape). Because of this, when movable upper jaw 2 closes, the large concrete block can be broken up along a breaking course at its center. Compared to prior art with a planar crushing surface and multiple crushing blades, it thus is possible to break large blocks with far less power.

In the present invention, concrete and concrete shapes are given as an example of objects to be crushed, but the present invention is not limited to this and can be effective with many types of material such as bedrock, rocks, wood, and the like.

Because the objects to be crushed which are scooped up naturally collect in the center, processing speed can be increased by reducing the work and time loss involved in position adjustment. Because the initial crushing which requires the greatest strength is done with a main crushing blade, the crushing strength is concentrated on the object. A smooth initial crushing is possible with a small amount of power. A wide block can be broken through the center because the ends of the V-shaped crushing surface support two points on the block. As a result, a large block can be crushed with a small amount of power.

A waste passage which opens in the lowermost portion of a stationary crushing surface is created on the stationary lower jaw and allows for the entrance of the main crushing blade. Crushed particles can be successively removed from the crushing surface. There is no need to stop operation due to blockage by crushed parts. Because waste passage 3 will receive main crushing blade 5 in the last step, the crushing process by supporting crushing blades 6 and crushing surfaces 1*a* and 2*a* can operate continuously, and a finer crushing is made possible.

Shredding blades are attached to both stationary lower jaw and movable upper jaw. Shredding action results from the mutual engagement of these blades. The cutting of steel reinforcements and steel frames in the concrete blocks becomes possible, and speeds the demolition process.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In a concrete crusher comprising a lower fixed jaw, and an upper movable jaw connected by a pivot to the lower fixed jaw for upper jaw closing movement toward and upper jaw opening movement away from the lower fixed jaw, the lower fixed jaw having a crushing surface on which a concrete piece can be received, the lower fixed jaw crushing surface having a waste passage opening located centrally therein, the upper movable jaw carrying a main crushing blade disposed orthogonal to a jaw pivot axis, the waste passage extending orthogonal to said pivot axis so that the main crushing blade can enter the waste passage opening in a terminal part of main crushing blade closing movement, the improvement wherein the lower fixed jaw crushing surface inclines downwardly from each of opposite crushing surface side margins to a crushing surface low point at said waste passage opening thereby defining a V-shaped crushing surface profile so that the concrete piece when received on said crushing surface locates symmetrically of a crushing surface centerline.

2. The concrete crusher of claim 1 further comprising at least one supporting crushing blade carried on said upper movable jaw at each of two opposite sides of said main crushing blade, each supporting crushing blade extending parallel to the pivot axis and having a lesser depth than the main crushing blade.

* * * * *